US009814996B2

(12) United States Patent
Janson

(10) Patent No.: US 9,814,996 B2
(45) Date of Patent: Nov. 14, 2017

(54) ANTI-ROLL AND SUSPENSION SYSTEM FOR RADIO CONTROLLED CAR

(71) Applicant: Joakim Richard Janson, Espoo (FI)

(72) Inventor: Joakim Richard Janson, Espoo (FI)

( * ) Notice: Subject to any disclaimer, the term of this patent is extended or adjusted under 35 U.S.C. 154(b) by 0 days.

(21) Appl. No.: 14/425,995

(22) PCT Filed: Sep. 13, 2013

(86) PCT No.: PCT/FI2013/000032
§ 371 (c)(1),
(2) Date: Mar. 4, 2015

(87) PCT Pub. No.: WO2014/041236
PCT Pub. Date: Mar. 20, 2014

(65) Prior Publication Data

US 2015/0217203 A1 Aug. 6, 2015

(30) Foreign Application Priority Data

Sep. 14, 2012 (FI) ..... 20120149 U

(51) Int. Cl.
*A63H 17/26* (2006.01)
*A63H 33/26* (2006.01)
*A63H 30/04* (2006.01)

(52) U.S. Cl.
CPC ..... *A63H 17/262* (2013.01); *A63H 30/04* (2013.01); *A63H 33/26* (2013.01)

(58) Field of Classification Search
CPC ..... A63H 17/00; A63H 17/26; A63H 17/262; A63H 33/26; A63H 30/04; B60G 17/00; B60L 13/10; F16F 15/005; F16F 15/03; F16F 6/00
See application file for complete search history.

(56) References Cited

U.S. PATENT DOCUMENTS 2,838,009 A * 6/1958 Bonanno ..... A63H 19/00 105/1.5
3,144,731 A * 8/1964 Jones ..... A63H 17/38 446/466
3,842,753 A * 10/1974 Theodore ..... B60G 17/0157 104/284

(Continued)

FOREIGN PATENT DOCUMENTS

DE 102009004545 A1 * 7/2010 ..... A63H 17/262
KR 2005014934 A * 2/2005
KR 2005067790 A * 7/2005

*Primary Examiner* — Gene Kim
*Assistant Examiner* — Alyssa Hylinski
(74) *Attorney, Agent, or Firm* — Michael D. Eisenberg

(57) ABSTRACT

The invention relates to the utilization of magnetism in the roll stabilization and suspension of a radio-controlled car. In small radio-controlled vehicles, in particular, it is difficult to implement the conventional mechanical roll stabilization and a well-functioning suspension due to the small size, the accuracy required, dirt, and the loads exerted on the structures. In the structure according to the invention, the roll stabilization and suspension are implemented by means of magnetism, according to FIG. 2. The magnets at the ends of supporting arms (6) attract each other, implementing the roll stabilization. Magnets (3) are installed under the supporting arm magnets, repelling them and providing suspension.

13 Claims, 2 Drawing Sheets

(56) References Cited

U.S. PATENT DOCUMENTS

| | | | | |
|---|---|---|---|---|
| 5,886,608 | A * | 3/1999 | Chabay | A63H 33/26 310/1 |
| 6,309,274 | B1 * | 10/2001 | Thomson | A63H 23/14 446/165 |
| 8,251,771 | B2 * | 8/2012 | Su | A63H 29/22 446/129 |
| 2002/0077025 | A1 * | 6/2002 | Wu | A63H 17/262 446/465 |
| 2002/0123296 | A1 * | 9/2002 | Tsang | A63H 17/36 446/444 |
| 2004/0012168 | A1 * | 1/2004 | Jaekel | B60G 13/00 280/124.1 |
| 2008/0303227 | A1 * | 12/2008 | Chi Chun Idiot | A63H 17/262 280/1 |

* cited by examiner

ANTI-ROLL AND SUSPENSION SYSTEM FOR RADIO CONTROLLED CAR

CROSS-REFERENCES TO RELATED APPLICATIONS

The present application is a 35 U.S.C. 371 application of PCT/FI2013/000032 filed Sep. 13, 2013, which claims the benefit of Finish Application Serial Number U20120149 filed Sep. 14, 2012, both of which are incorporated by reference herein.

TECHNICAL FIELD

The invention relates to the utilization of magnetism in the roll stabilization and suspension of a radio-controlled car.

BACKGROUND OF THE INVENTION

The invention utilizes known chassis solutions, which are related to the tyre suspension of radio-controlled vehicles and which are commonly used by hobbyists, and the well-known properties of magnets, combining them in an unparalleled way.

In small radio-controlled vehicles, in particular, the conventional mechanical roll stabilization is difficult to implement due to the small size, the accuracy required, dirt, and the loads that are exerted on the structures. In addition, the springs and other structures that are conventionally used are susceptible to dirt and wear, causing a continuous change in the properties, thus complicating the adjustment of the car and requiring a lot of maintenance.

These existing patents are identified in connection with the invention:

1. DEI 02009018467 (A1)—Model or toy car, has adjusting element i.e. adjustment plate, provided for displacing one of magnet-support surfaces to change magnetic distance, spring deflection and base clearance 2. DEI 02009004545 (A1)—Model or toy car, has guide device provided for moving two permanent magnets consecutively by overcoming magnetic repulsive force, where guide device is designed as hollow body and magnets are provided in independent suspension system These patents comprise the use of magnets in the suspension system of the radio-controlled car and in the adjustment of the suspension for single tires. The invention presented in this document deals with the interactive suspension of adjacent tires, the adjustment of the suspension, and it implements the roll stabilization that is not included in the patents mentioned above.

BRIEF SUMMARY OF EMBODIMENTS OF THE INVENTION

The structure according to the invention is characterized in the utilization of the forces of magnets that repel and attract each other. The stabilizing structure according to the invention is shown in FIG. 1, and the combined magnetic suspension and roll stabilizing anti-roll structure is shown in FIG. 2.

The structure according to the invention brings about several significant advantages:

1. An effective and adjustable roll stabilization, which is easy to implement in an existing structure.

2. A structure that removes the unwanted play of the structure.

3. A small starting friction and smooth operation compared with the commonly used structure.

4. It has been discovered that the operation of the structure, according to the invention, requires only a small amount of grease. This is of great importance, because the greases that are used in conventional suspension systems are very quickly fouled by the rubber that comes off the tyres during driving, whereby their properties change. The need for cleaning and maintenance of the solution, according to the invention, is minor and the adjustments of the car chassis do not considerably change between maintenance.

5. A versatile and easy adjustment of the stiffness of the suspension, the surface hardness, and the progression of the suspension.

6. The structure is simple and inexpensive to implement, yet its performance is excellent.

BRIEF DESCRIPTION OF THE DRAWINGS

In the following, the invention is shown in more detail with reference to the appended drawings, in which.

DETAILED DESCRIPTION OF THE EMBODIMENTS OF THE INVENTION

Figure 1:
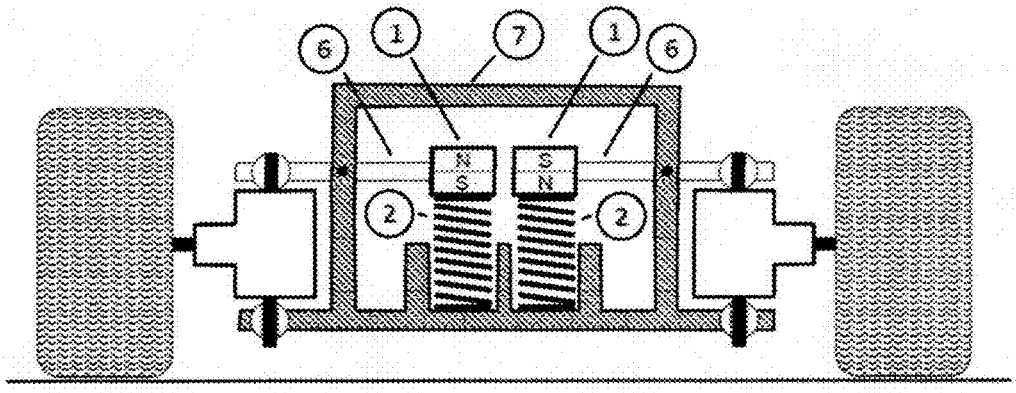
FIG. 1 shows a conventional front suspension solution, whereto the roll stabilization implemented by magnets is added.
Figure 2:
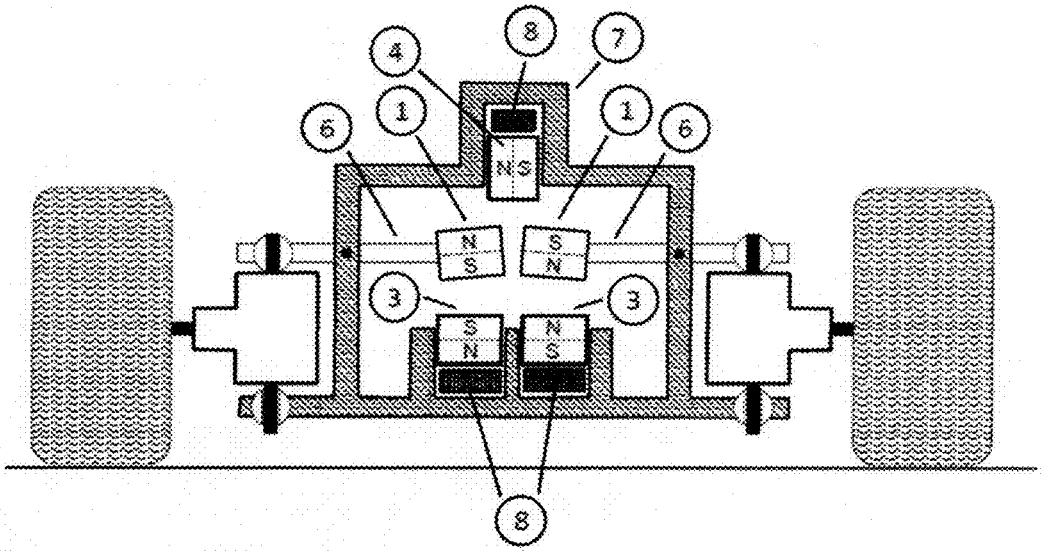
FIG. 2 shows the combined roll stabilization and suspension, which is implemented by magnets.

FIG. 1 shows the front suspension solution that is generally used by the hobbyists, excluding the magnets (1), which are shown in the figure and which implement the roll stabilization according to the invention. The magnets (1), according to the invention, are placed at the ends of the supporting arms (6) that are used in the suspension, so that they attract each other. The supporting arms now follow each other without locking into each other, and the roll stabilization is implemented. The solution can be applied to front and rear axles. In FIG. 1, the suspension is implemented by means of solutions that are generally used, mechanical springs (2). However, a magnetic suspension can be combined with the magnetic roll stabilization, according to FIG. 2. In that case, magnets (3) are placed below the stabilizer magnets (1), so that they repel the stabilizer magnets (1). In this way, a progressive suspension that is provided with roll stabilization is achieved, which has a fairly simple structure and which offers a number of adjustment possibilities. The number of adjustment possibilities can be increased by adding, above the stabilizer magnets (1), a magnet (4) that is attached to the body and that repels the stabilizer magnets (1). In the following, there are adjustment possibilities of the roll stabilization and suspension arrangement that is implemented in this way:

The intensity of the roll stabilization can be adjusted by adjusting the distance between the magnets (1), the intensity, and the shape of the magnets or the direction of the magnetic flux.

The strength of the suspension can be adjusted by adjusting the intensity and the location of the magnets (3) or the direction of the magnetic flux. In the test version according to FIG. 2, this is implemented by stacking several superimposed magnets to constitute the magnet (3), whereby the adjustment is simply carried out by changing the number of superimposed magnets.

The response, progression and ground clearance of the suspension can be adjusted by adjusting the intensity, shape or distance of the magnet (4) from the stabilizer magnets (1). In the test version according to FIG. 2, this is implemented by a flexible piece of fibreglass, which is attached to the body and the stiffness of which can be adjusted by a screw (5).

NB. The magnetic polarities shown in FIGS. 1 and 2 and the positions of the magnetic poles are suggestive, with a purpose of presenting the operating principle.

What is claimed is:

1. A combined roll stabilization and suspension system for front and/or rear axles of a vehicle, wherein the roll stabilization is achieved by a pair of magnets attached to ends of suspension arms with each arm mechanically connected to a respective tire in either a front tire pair or a rear tire pair, with the magnets' respective polarities oriented so that the magnets attract each other and the suspension arm ends are oriented to face each other;

a pair of bottom magnets which are attached to a body of the vehicle and which repel the pair of magnets attached to the suspension arm ends;

the suspension arms having a long axis that is perpendicular to a direction of a repelling force between the pair of bottom magnets attached to the body of the vehicle and the pair of magnets attached to the ends of the suspension arms and parallel to a direction of an attractive force between the magnets on the suspension arms.

2. The combined roll stabilization and suspension system of claim 1, wherein a hardness of a surface suspension and a progression of the suspension are adjusted by means of a top magnet, which is placed on top of and perpendicular to the polarity orientations of the pair of suspension arm magnets repelling them and attached to the body.

3. The combined roll stabilization and suspension system of claim 1, wherein the suspension is adjustable by changing an intensity of the magnets of the stabilizer arms and the body, a distance between them, a direction of a field thereof, and a shape of the magnets.

4. The combined roll stabilization and suspension system of claim 1, wherein the pair of bottom magnets is attached to the body of the vehicle below the pair of suspension arm magnets attached to the suspension arms, and a single top magnet is attached to the body of the vehicle above the pair of suspension arm magnets.

5. The combined roll stabilization and suspension system of claim 2, wherein a response, progression, and ground clearance of the suspension can be adjusted by attaching the top magnet with a flexible plate to the body of the vehicle and adjusting its stiffness and position with a screw.

6. The combined roll stabilization and suspension system of claim 3, wherein the strength of the suspension is adjusted by each of the pair of bottom magnets including stacked magnets.

7. A combined roll stabilization and suspension system for a vehicle, comprising:

a top magnet;

a pair of suspension arm magnets;

a pair of bottom magnets;

a pair of suspension arms each arm connected to respective left and right tires disposed on either side of the vehicle;

wherein a first suspension arm magnet is placed closest to a vehicle center line end of a first suspension arm, a second suspension arm magnet is placed closest to the vehicle center line end of a second suspension arm, the pair of bottom magnets are placed below the suspension arm magnets, and the top magnet is placed above the suspension arm magnets.

8. The combined roll stabilization and suspension system of claim 7, wherein the pair of bottom magnets repels the suspension arm magnets, and the top magnet repels the upper arm magnets.

9. A combined roll stabilization and suspension system for a vehicle, comprising:

left and right suspension arms in a suspension assembly connected to left and right tires on respective left and right sides of a vehicle, the arms having ends that face each other and are separated by a space;

suspension arm magnets attached to each end of the left and right arms, with polarities oriented so that the magnets attract each other;

wherein movement of one suspension arm communicates a force to the arm that faces it via the magnets.

10. The combined roll stabilization and suspension system of claim 9, further comprising left and right bottom magnets attached to a body of a vehicle, each bottom magnet oriented to repel a respective suspension arm magnet attached to the suspension arm.

11. The combined roll stabilization and suspension system of claim 9, further comprising a top magnet with a polarity oriented perpendicular to the polarity orientations of the suspension arm magnets attached to the ends of the left and right suspension arms, disposed with one end repelling the suspension arm magnet attached to the left suspension arm and with an opposite end repelling the suspension arm magnet attached to the right suspension arm.

12. The combined roll stabilization and suspension system of claim 9, further comprising left and right bottom magnets attached to a body of a vehicle, each magnet oriented to repel a respective suspension arm magnet attached to the suspension arm; and a top magnet with a polarity oriented perpendicular to the polarity orientations of the suspension arm magnets attached to the ends of the left and right suspension arms, disposed with one end repelling the suspension arm magnet attached to the left arm and with an opposite end repelling the suspension arm magnet attached to the right arm.

13. The combined roll stabilization and suspension system of claim 12, wherein the bottom magnets attached to the body of the vehicle are below the suspension arm magnets attached to the suspension arms and the top magnet with polarity oriented perpendicular to the polarity orientations of the suspension arm magnets attached to the ends of the left and right suspension arms, is disposed above the suspension arms.

* * * * *